United States Patent [19]

Warren

[11] Patent Number: 4,858,533

[45] Date of Patent: Aug. 22, 1989

[54] CASED TELESCOPED AMMUNITION ROUND FOR A FIN STABILIZED PROJECTILE

[75] Inventor: J. Bruce Warren, Wayzata, Minn.

[73] Assignee: Honeywell Inc., Minneapolis, Minn.

[21] Appl. No.: 190,908

[22] Filed: May 6, 1988

[51] Int. Cl.[4] ..... F42B 5/02

[52] U.S. Cl. ..... 102/434; 102/521

[58] Field of Search ..... 102/430, 431, 433, 434, 102/439, 443, 521, 703, 513

[56] References Cited

U.S. PATENT DOCUMENTS

| | | | |
|---|---|---|---|
| 390,232 | 10/1888 | Hurst | 102/443 |
| 2,866,412 | 12/1958 | Meyer et al. | 102/430 |
| 2,996,988 | 8/1961 | Kunz | 102/430 |
| 3,482,516 | 12/1969 | Farmer et al. | 102/433 |
| 3,732,819 | 5/1973 | Quinlan et al. | 102/433 |
| 3,834,314 | 9/1974 | Young | 102/521 |
| 3,892,181 | 7/1975 | Goldin | 102/434 |
| 3,902,424 | 9/1975 | Dietsch et al. | 102/513 |
| 4,335,657 | 6/1982 | Bains | 102/433 |
| 4,542,696 | 9/1985 | Bisping et al. | 102/430 |
| 4,604,954 | 8/1986 | Clarke et al. | 102/434 |

*Primary Examiner*—Harold J. Tudor

*Attorney, Agent, or Firm*—R. W. Jensen; E. W. Hughes

[57] ABSTRACT

A cased telescoped ammunition round 40 for a fin stabilized penetrator projectile 50. A cylindrical core tube 48 is positioned within the casing 42. Projectile 50 and its sabot 52 are positioned within core tube 48. The space between core tube 48 and casing is filled with the main charge 66. An igniter 62 is located in the rear seal 46 of casing 42 and when initiated, ignites booster charge 64 located within core tube 48 between sabot 52 and rear seal 46. Ignition ports 70 in core tube 48 permit the ignition products of booster charge 64 to ignite main charge 66 when sabot 52 moves a predetermined distance through core tube 48.

15 Claims, 1 Drawing Sheet

CASED TELESCOPED AMMUNITION ROUND FOR A FIN STABILIZED PROJECTILE

BACKGROUND OF THE INVENTION (1) Field of the Invention

This invention is in the field of cased telescoped ammunition, and more particularly relates to cased telescoped ammunition rounds in which the projectiles are fin stabilized subcaliber penetrators, with the penetrator of each such round being provided with a sabot which separates from the projectile as the projectile and sabot exit the barrel of the gun from which fired.

(2) Description of Related Art

Cased telescoped ammunition in which the projectile is completely enclosed, or telescoped within the cartridge case, reduces the volume required for a gun, ammunition storage and feed mechanism, or gun system using such ammunition by a significant amount compared with equivalent gun systems using conventionally shaped rounds. The cylindrical shape of cased telescoped cartridges allows for a simpler more reliable and more compact gun system with a higher rate of fire.

In cased telescoped ammunition the projectile is accelerated initially by a booster charge to close, or to obturate, the barrel of the gun before the main propelling charge is ignited. A control tube is commonly used to control the initial movement of the projectile. A booster charge is located in the control tube and is separated by the tube from the main propelling charge. The booster charge is initially confined within the control tube by a booster piston which is attached to the base of the projectile. Main charge ignition does not occur until the advancing piston clears the tube, or exposes or unblocks, ignition ports in the wall of the control tube which, permits products of the burning booster charge to ignite the main charge. Ignition of the main charge is controlled by the position of the projectile. Main propellant ignition occurs when the projectile is at a known and reproducible location in the round and in the barrel of the gun from which it is being fired. Projectile velocity should be at a minimum when main propellant ignition occurs and there should be no venting, blow-by, or pressure leakage of the gases produced by the ignited main propellant as the projectile accelerates down the gun barrel.

Because of the advantages derived from using cased telescoped ammunition rounds, there is a need to develop such a round in which the projectile is a fin stabilized kinetic energy armor penetrating projectile, or penetrator, as such projectiles are commonly used in vehicle mounted gun systems to attack armored vehicles, fixed fortifications, and the like. However, attempting to use a control tube and booster piston which is satisfactory for ejecting spin stabilized projectiles from cased telescoped rounds such as is taught by U.S. Pat. No. 4,604,954 to eject, or launch, fin stabilized penetrators has encountered problems. Fin stabilized kinetic energy penetrators have relatively high length to diameter (L/D) ratios, in the range of from 6.0 to 20.0, with the result that such projectiles cannot accept high loads in the vicinity of the fins in the absence of a substantially uniform force acting over the entire rearward portion of the projectile. Stated another way, a fin stabilized penetrator is not capable of accepting the forces applied to it by conventional cased ammunition without damage to the fins, sabot or penetrator.

Since the control tube and booster piston of conventional cased telescoped ammunition rounds are directly in line with and behind the projectile, their use with fin stabilized projectiles can result in excessively high round lengths.

Attaching the control tube to the rear of a fin stabilized penetrator reduces the stabilizing effect of the fins as well as inhibiting the mounting of a tracer cup in the base of the penetrator so that its trajectory can be visually observed.

SUMMARY OF THE INVENTION

The present invention provides a cased telescoped ammunition round for a fin stabilized penetrator projectile. The cylindrical casing is provided with a core tube positioned within the casing with the length of the core tube being substantially equal to the length of the casing. One end, or base, of the core tube is in contact with the rear seal of the casing and the other end substantially lies in the plane forming the forward end, or base, of the round. The fin stabilized penetrator and its associated sabot are positioned within the core tube, with the outer cylindrical surfaces of the sabot being in sliding contact with the inner surface of the core tube. The finned end of the penetrator is located proximate the rear seal. The space within the core tube between the rear seal and the rear portion of the sabot contains a booster charge. A primer is mounted in the rear seal and when initiated, the primer ignites the booster charge in the rear portion of the core tube. In the space between the casing and the core tube and between the rear and forward seals, the main charge, an annular shaped consolidated propellant, is located. Ignition ports are formed in the forward portion of the core tube so that the booster propellant when ignited by the primer can ignite the main charge, when the pressure produced by the burning booster propellant has advanced the fin stabilized projectile and its sabot a sufficient distance so that the forward portion of the sabot has penetrated sufficiently far into the gun barrel to obturate the barrel and to stabilize the sabot and projectile, the main propellant charge is ignited by the sabot's unblocking the ignition path to the main charge through the ignition ports. The path of the projectile and sabot in the barrel after the main charge is ignited is sufficiently stable to substantially eliminate damage to the projectile and sabot while accelerating the projectile to its desired muzzle velocity.

Damage to the rear portion of the projectile is essentially eliminated since the only unbalanced force due to ignition of the booster charge and the main charge is applied to the rear portion of the sabot which is designed to take such loads.

Accepting an excessive overall length of a round for a cased telescoped ammunition round firing fin stabilized projectiles of a given length using a control tube and piston, or shortening the length of the projectile, with neither of these courses of action being desirable, can thus be avoided. The round of this invention which eliminates the use of a control tube and a booster piston reduces the length of the round for a given length of projectile by a substantial percentage. Since there is no need for a control piston to be secured to the rear of the projectile aft of the fins, a tracer cup can be mounted in the rear or base of the penetrator.

It is, therefore, an object of this invention to provide an improved cased telescoped ammunition round with a fin stabilized penetrator in which substantially no unbalanced forces are applied to the finned portion of the penetrator by gases produced by the booster propellant while injecting the penetrator and its sabot into the barrel of the gun from which the round is fired.

It is another object of this invention to provide an improved telescoped ammunition round with a fin stabilized penetrator in which a tracer can be mounted in the rear of the projectile.

It is yet another object of this invention to provide an improved telescoped ammunition round with a fin stabilized penetrator in which the fins are mounted at the rear of the penetrator with the fins in close proximity to the rear seal of the casing of the round prior to being fired.

BRIEF DESCRIPTION OF THE DRAWING

Other objects, features and advantages of the invention will be readily apparent from the following description of a preferred embodiment thereof, taken in conjunction with the accompanying drawings, although variations and modifications may be affected without departing from the spirit and scope of the novel concepts of the disclosure, and in which.

DESCRIPTION OF PREFERRED EMBODIMENT

Figure 1:
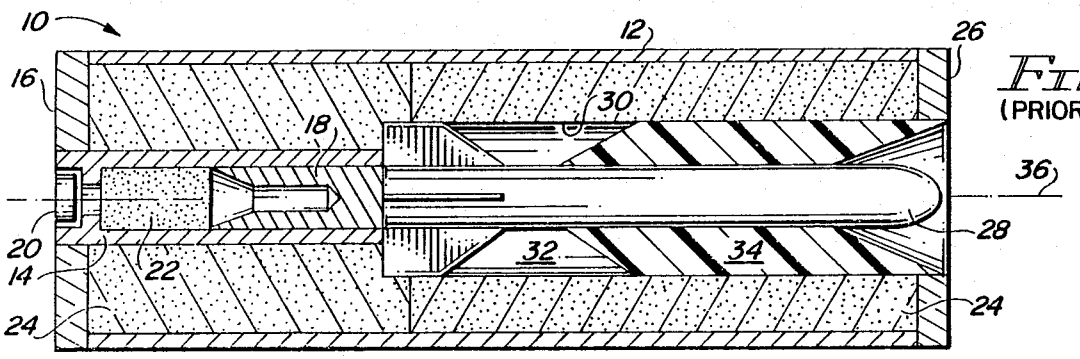
FIG. 1 (PRIOR ART)
FIG. 1 is a section of a prior art cased telescoped ammunition round with a fin stabilized projectile.

In FIG. 1, a prior art round 10 of cased telescoped ammunition for a fin stabilized projectile having a cylindrical case 12 is illustrated. A control tube 14 is mounted in the rear seal 16 of case 12. A booster piston 18 is positioned within control tube 14. The space within control tube 14 between piston 18 and primer 20, which is mounted in rear seal 16 has a booster charge 22 positioned therein. Main propellant charge 24 is positioned within case 12 between rear seal 16 and forward seal 26. Finned penetrator projectile 28 is positioned in a cylindrical opening 30 formed in the main propellant charge 24. Booster piston 18 is fixedly secured to the rear end of projectile 28 aft of fins 32 to substantially eliminate muzzle debris. When round 10 is to be fired from a gun in the chamber of which it is loaded, firing begins by initiating primer 20 to ignite the booster propellant 22. This moves penetrator 28 and its sabot 34 forward into the barrel of a gun from which fired, which gun is not illustrated in FIG. 1. The force to move penetrator 28 and sabot 34 is applied by booster piston 18 to the base of penetrator 28 to which piston 18 is securely attached. Initial guidance, or control, of the trajectory of penetrator 28 and sabot 34 as it moves along axis of symmetry 36 of round 10 is by control tube 14 and piston 18. Main propellant charge 24 is ignited by the burning booster propellant 22 after piston 18 moves out of control tube 14 as penetrator 28 is ejected from round 10.

Figure 2:
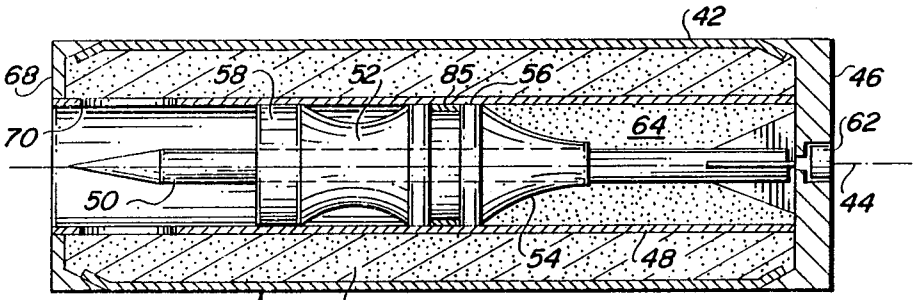
FIG. 2 is a section of a preferred embodiment of a cased telescoped ammunition round with fin stabilized penetrator projectile embodying this invention.

In FIG. 2, round 40, a cased telescoped ammunition round with a fin stabilized penetrator projectile, has a right circular cylindrical outer casing 42. Axis 44 of round 40 is the axis of symmetry, or longitudinal axis, of casing 42. Rear seal 46 closes off the rear end of casing 42. Core tube 48, a right circular cylindrical ring, is mounted on seal 46 within casing 42 and with its axis of symmetry, or longitudinal axis, substantially coinciding with axis 44 of casing 42 and round 40. The diameter of penetrator 50 which has a high length to diameter (L/D) ratio, is substantially less than the diameter of the inner cylindrical surface of core tube 48. To position penetrator 50 in core tube 48 and to prevent gun gas from flowing around, or bypassing, penetrator 50 when round 40 is fired from a conventional gun so that penetrator 50 exits the muzzle of the gun with the maximum muzzle velocity, sabot 52 is mounted around penetrator 50. Sabot 52 has an aft portion 54 which includes a substantially cylindrical bore-riding surface 56 and a forward substantially cylindrical bore-riding surface 58. The diameters of surfaces 56, 58 are substantially equal to that of the inner surface of core tube 48 and the inner diameter of, or the calibre of, the bore of the gun from which round 40 is fired. Obturator 85 prevents gas from escaping past the sabot. Penetrator 50 and sabot 52 are positioned in core tube 48 with the fins 60 of penetrator 50 at the base, or aft end, of penetrator 50 proximate rear seal 46. Primer 62 is mounted in rear seal 46 substantially centered on axis 44. Booster charge 64 is positioned in the space within core tube 48 between rear seal 46 and the aft portion 54 of sabot 52. In the preferred embodiment booster charge 64 is a granular propellant such as a single base, single perforation military grade propellant which facilitates loading charge 64 into round 40.

Figure 3:
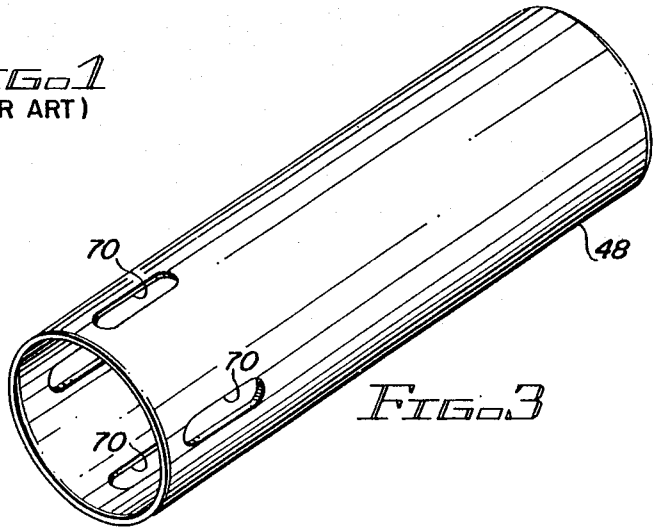
FIG. 3 is a perspective of the core tube of the embodiment illustrated in FIG. 2.

Main charge 66 is positioned in the space between casing 42, core tube 48, rear seal 46 and forward seal 68. In the preferred embodiment main charge 66 is an annulus of consolidated propellant ring or tube made from a single base, single perforation military grade propellant. In FIG. 3, the location of ignition ports 70 in core tube 48 are illustrated, the function of which is set forth below.

Figure 4:
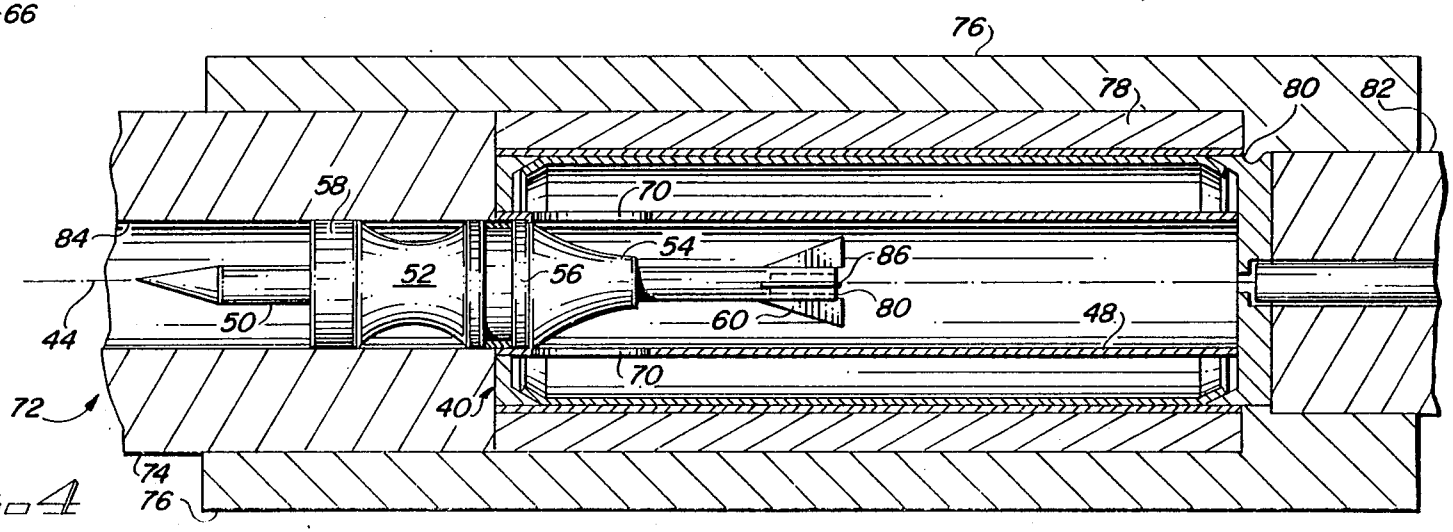
FIG. 4 is a section through a portion of a gun showing the position of the projectile and sabot of a round embodying this invention as the projectile and sabot are ejected from the round into the barrel of the gun.

In FIG. 4, conventional gun 72 has its rifled barrel 74 fitted into breech block 76. Chamber liner 78 is positioned within breech block 76 aft of barrel 74. Round 40 is inserted into the chamber of gun 72 defined by the inner surface of chamber liner 78 through the breech opening 80 in breech block 76; for example, after round 40 is loaded into the chamber. Bolt 82 closes opening 80. Centrally located in bolt 82 is a conventional firing mechanism which is not illustrated. For example such a mechanism could drive a firing pin into primer 62 or discharge an electrical current through primer 62 to initiate primer 62 which causes primer 62 to ignite booster charge 64. In FIG. 4 primer 62 has been initiated by the firing mechanism in bolt 82 and has ignited booster charge 64. Pressure of the gases released by burning booster charge 64 act on the aft portion 54 of sabot 52 to accelerate projectile 50 and sabot 52 on a trajectory substantially coinciding with axis 44.

The initial trajectory, or path, of penetrator 50 and sabot 52 is determined by core tube 48. The forces acting on projectile 50 and sabot 52 eject them from round 40 into the bore 84 of barrel 74. It should be noted that the longitudinal axis of bore 84 substantially coincides with the axis 44 of round 40. When projectile 50 and sabot 52 have travelled far enough along axis 44 so obturator 85 of sabot 52 is in contact with the inner cylindrical surface of barrel 74 defining bore 82, the ignition ports 70 in core tube 48 are exposed so that the burning booster propellant 64 ignites main charge 66.

The force produced by main charge 66 when ignited accelerates projectile 50 and sabot 52 to the desired muzzle velocity.

By using core tube 48 to guide sabot 52 and projectile 50 during that portion of the movement of sabot 52 during which the aft bore riding ring 56 remains in contact with tube 48, deviations of sabot 52 and projectile 50 from the desired initial trajectory are minimized. Further, no unbalanced forces are applied to the structure of projectile 50 aft of the aft portion 54 of sabot 52, and particularly none are applied to fins 60 by booster propellant 64 or main charge 66 when it is ignited. As a result, damage to projectile 50 particularly to its fins 60 or sabot 52 during firing which damage would have a deleterious effect on the performance of projectile 50 is essentially eliminated.

A conventional tracer cup 86 can be mounted in the base 88 of penetrator 50 as illustrated in FIG. 4. Tracer cup 86 is ignited by booster propellant charge 64 as projectile 50 is driven down axis 44 by propellant charge 64.

Since no modifications to projectile 50 to adapt it to be fired from the improved round of this invention are required, projectile 50 can be provided with a tracer cup located in its aft end, or base, as is well known in the art.

In the preferred embodiment casing 42 can be fabricated from a metal such as steel or a suitable plastic such as a glass reinforced resin composite. Core tube 40, is preferably fabricated from steel, or alternatively from a relatively slow burning propellant such as nitro cellulose.

While the principles of the invention have now been made clear in the illustrated embodiment, there will be immediately obvious to those skilled in the art many modifications of structure, arrangements, proportions, the elements, materials and components used in the practice of the invention and otherwise which are particularly adapted for specific environments and operation requirements without departing from those principles. The appendant claims are therefore intended to cover and embrace any such modifications within the limits only of the true spirit and scope of the invention.

What is claimed is:

1. A cased telescoped ammunition round 40 comprising;

a casing 42, having a front end and a rear end;

a rear seal 46 closing the rear end of the casing 42;

a front seal 68 mounted on the front end of the casing 42;

a core tube 48 positioned within the casing 42 in contact with the rear seal 46 and the front seal 68;

a fin stabilized penetrator 50 having fins 60;

a sabot 52 mounted on the penetrator 50, said sabot and penetrator 50 being positioned completely within the core tube 48 with the fins 60 of the penetrator substantially in contact with the rear seal 46;

a main propellant charge 66 positioned around core tube 48 within casing 42 and between the front and rear seals 68, 46;

a booster propellant charge 64 positioned in the space defined by the core tube 48, the rear seal 46, the sabot 52 and the penetrator 50;

primer means 62 mounted in the rear seal 46 for igniting the booster propellant charge 64 when initiated; and means 70 for providing an ignition path for the ignited booster propellant charge 64 to ignite the main propellant charge 66 when the sabot 52 has moved a predetermined distance with respect to the core tube 48.

2. A cased telescoped ammunition round 40 as set forth in claim 1 in which the main propellant charge 66 is a ring of consolidated propellant.

3. A cased telescoped ammunition round 40 as set forth in claim 2 in which the booster propellant charge 64 is a loose granular propellant.

4. A cased telescoped ammunition round 40 as set forth in claim 3 in which the core tube 48 is made of steel.

5. A cased telescoped ammunition round 40 as set forth in claim 4 in which the penetrator 50 has a base 88 and a tracer cup 86 is mounted in the base 88 of penetrator 50.

6. A cased telescoped ammunition round 40 comprising:

a casing 42 having two bases;

a rear seal 46 closing one base;

a primer 62 mounted in the rear seal;

a core tube 48 having a length;

a fin stabilized penetrator 50 having a length;

a sabot 52 mounted on the penetrator 50, said penetrator 50 and sabot 52 being positioned completely within core tube 48;

said core tube 48 being mounted in said casing 42, the length of the core tube being substantially equal to the length of the casing 42 and the length of the penetrator 50 being substantially equal to that of the core tube 48;

a cylindrical ring of consolidated propellant 66 positioned around the core tube 48 and within the casing 42;

loose granules of propellant 64 positioned in the core tube 48 between the primer 62 mounted in the rear seal 46 and the sabot 52 mounted on penetrator 50; and ignition ports 70 formed through the core tube 48, the fin stabilized penetrator 50 and sabot 52 preventing communication between the granules of propellant 64 and the consolidated propellant 66 until sabot 52 and penetrator 50 move a predetermined distance within core tube 48.

7. A cased telescoped ammunition round 40 as set forth in claim 6 in which the consolidated propellant 66 is a single base single perforation propellant.

8. A cased telescoped ammunition round 40 as set forth in claim 7 in which the granular propellant 64 is a single base single perforation propellant.

9. A cased telescoped ammunition round as set forth in claim 8 in which the core tube 48 is made of steel.

10. A cased telescoped ammunition round 40 as set forth in claim 9 in which the casing 42 is made of a plastic material.

11. A cased telescoped ammunition round 40 comprising;

casing means 42 having a rear and a front end, a length, and forming a right circular ring;

rear seal means 46 for closing the rear end of the casing means 42;

front seal means secured to the front end of the casing means 42;

core tube means 48 having a rear end and a front end, a length, and forming a right circular tube;

a fin stabilized penetrator 50 having a pointed tip at one end and a base 88, a plurality of stabilizing fins 60 mounted at the base end 88;

a sabot 52 mounted on the fin stabilized penetrator 50, said sabot 52 having a forward bore riding surface 58 and a rearward portion 54 including an obturator 85; said fin stabilized penetrator 50 and sabot 52 being positioned completely within the core tube means 48 with the core tube means 48 positioned completely within the casing means 42 and contacting the front seal means 68 and the rear seal means 46, and with the fins 60 of the penetrator 50 proximate the rear seal means 46, the initial position of the penetrator 50 in round 40;

a primary propellant means 66 positioned between the casing 42 and the core tube means 48;

initiating propellant means 64 positioned within the core tube means 48 between the rear seal means 46 and the sabot 52 mounted on the penetrator 50;

igniter means 62 mounted on the rear seal means 46 for igniting the initiating propellant means 64 when the igniter means 62 is activated; and ignition port means 70 through the core tube means 48 for providing an ignition path from the initiating propellant means 64 through the ignition port means 70 to the primary propellant means 66, said ignition path being blocked by the sabot 52 and penetrator 50 while the penetrator 50 is in its initial position; said igniter means 62 when activated igniting the initiating propellant means 64 to move the penetrator 50 and sabot 52 down the core tube means 48 toward the front end of the core tube means 48, said sabot 52 and penetrator 50 unblocking the ignition path to the primary propellant means 66 when the forward bore riding surface 58 of sabot 52 exits core tube means 48 a predetermined distance to ignite the primary propellant means 66.

12. A cased telescoped ammunition round 40 as set forth in claim 11 in which the initiating propellant means 64 is a granular propellant.

13. A cased telescoped ammunition round 40 as set forth in claim 12 in which the primary propellant means 66 is a consolidated propellant.

14. A cased telescoped ammunition round 40 as set forth in claim 13 in which the casing means 42 is made of a plastic material.

15. A cased telescoped ammunition round 40 as set forth in claim 14 in which a tracer cup 86 is mounted in the base of the fin stabilied penetrator 50.

* * * * *